US005124683A

United States Patent [19]

Brunner

[11] Patent Number: 5,124,683

[45] Date of Patent: Jun. 23, 1992

[54] BINGO FLASHER APPARATUS

[76] Inventor: Roberta M. Brunner, 700 N. 14th St., Springfield, Ill. 62702

[21] Appl. No.: 699,515

[22] Filed: May 14, 1991

[51] Int. Cl.[5] ..... A63B 71/06

[52] U.S. Cl. ..... 340/323 R; 340/321; 273/148 R

[58] Field of Search ..... 340/323 R, 321, 331, 340/332; 362/190, 191; 116/307, 309; 273/148 R, 269

[56] References Cited

U.S. PATENT DOCUMENTS

| | | | |
|---|---|---|---|
| 1,205,628 | 11/1916 | Hitzelberger | 340/321 |
| 2,638,583 | 5/1953 | Edwards, Jr. | 362/190 X |
| 3,071,764 | 1/1963 | Frezieres | 340/321 |
| 3,810,164 | 5/1974 | Lambert | 340/332 |
| 3,967,274 | 6/1976 | Howell | 340/321 X |
| 4,080,596 | 3/1978 | Keck et al. | 340/323 R |
| 4,250,491 | 2/1981 | Dotson | 340/321 |
| 4,572,510 | 2/1986 | Green | 273/148 R |
| 4,796,172 | 1/1989 | Chestnut | 362/190 X |
| 4,830,375 | 5/1989 | Fleming | 273/148 R |
| 5,067,895 | 11/1991 | Chuang et al. | 273/148 R X |

*Primary Examiner*—Jin F. Ng
*Assistant Examiner*—Brian R. Tumm
*Attorney, Agent, or Firm*—Leon Gilden

[57] ABSTRACT

An apparatus arranged for securement to a chair member or alternatively as a mobile unit mounted on wheels, wherein the organization includes an indicator bulb selectively operated through a switch and a counter, whereupon an individual providing indication of "win" in a bingo game tuns on a switch to illuminate the associated bulb with the counter arranged for indicating which game is a "winning" game.

3 Claims, 4 Drawing Sheets

BINGO FLASHER APPARATUS

BACKGROUND OF THE INVENTION

1. Field of the Invention

The field of invention relates to bingo apparatus, and more particularly pertains to a new and improved bingo flasher apparatus wherein the same is arranged for providing visual indication of winning in a bingo game scenario.

2. Description of the Prior Art

In play of bingo games, frequently winning individuals must demonstratively and physically indicate a Winning game by drawing attention to themselves. While additional games are in progress, the winner is thereby distracted from directing attention to ongoing games. The signal device is arranged to preclude such distraction and provide indication of which game has been won by the aforenoted "winner". The prior art utilizes bingo indicator members and such is exemplified in U.S. Pat. No. 4,572,510 to Green which is directed as a wand member.

U.S. Pat. No. 3,775,887 to precourt sets forth a portable signal device utilizing a telescoping handle.

U.S. Pat. No. 4,250,491 to Dotson sets forth a signal device for mounting upon a table utilizing a light bulb mounted to a top surface thereof.

U.S. Pat. No. 2,882,629 to Moebius sets forth a further display sign that is arranged with a lower tubular end for mounting to a tapered neck bottle member.

Accordingly, it may be appreciated that there continues to be a need for a new and improved bingo flasher apparatus as set forth by the instant invention which addresses both the problems of ease of use as well as effectiveness in operation for directing attention to an associated winner of a bingo game and in this respect, the present invention substantially fulfills this need.

SUMMARY OF THE INVENTION

In view of the forgoing disadvantages inherent in the known types of bingo indicator apparatus now present in the prior art, the present invention provides a bingo flasher apparatus Wherein the same is arranged for indicating a signal for a winner of a bingo game scenario. As such, the general purpose of the present invention, which will be described subsequently in greater detail, is to provide a new and improved bingo flasher apparatus which has all the advantages of the prior art bingo apparatus and none of the disadvantages.

To attain this, the present invention provides an apparatus arranged for securement to a chair member, or alternatively as a mobile unit mounted on wheels, wherein the organization includes an indicator bulb selectively operated through a switch and a counter, whereupon an individual providing indication of "win" in a bingo game turns a switch on to illuminate the associated bulb with the counter arranged for indicating which game is a "winning" game.

My invention resides not in any one of these features per se, but rather in the particular combination of all of them herein disclosed and claimed and it is distinguished from the prior art in this particular combination of all of its structures for the function specified.

It is therefore an object of the present invention to provide a new and improved bingo flasher apparatus which has all the advantages of the prior art bingo apparatus and none of the disadvantages.

It is another object of the present invention to provide a new and improved bingo flasher apparatus which may be easily and efficiently manufactured and marketed.

It is a further object of the present invention to provide a new and improved bingo flasher apparatus which is of a durable and reliable construction.

An even further object of the present invention is to provide a new and improved bingo flasher apparatus which is susceptible of a low cost of manufacture with regard to both materials and labor, and which accordingly is then susceptible of low prices of sale to the consuming public, thereby making such bingo flasher apparatus economically available to the buying public.

Still yet another object of the present invention is to provide a new and improved bingo flasher apparatus which provides in the apparatuses and methods of the prior art some of the advantages thereof, while simultaneously overcoming some of the disadvantages normally associated therewith.

Still another object of the present invention is to provide a new and improved bingo flasher apparatus wherein the same s arranged for self-supported mobility of mounting to a chair of an associated bingo player.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWING

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
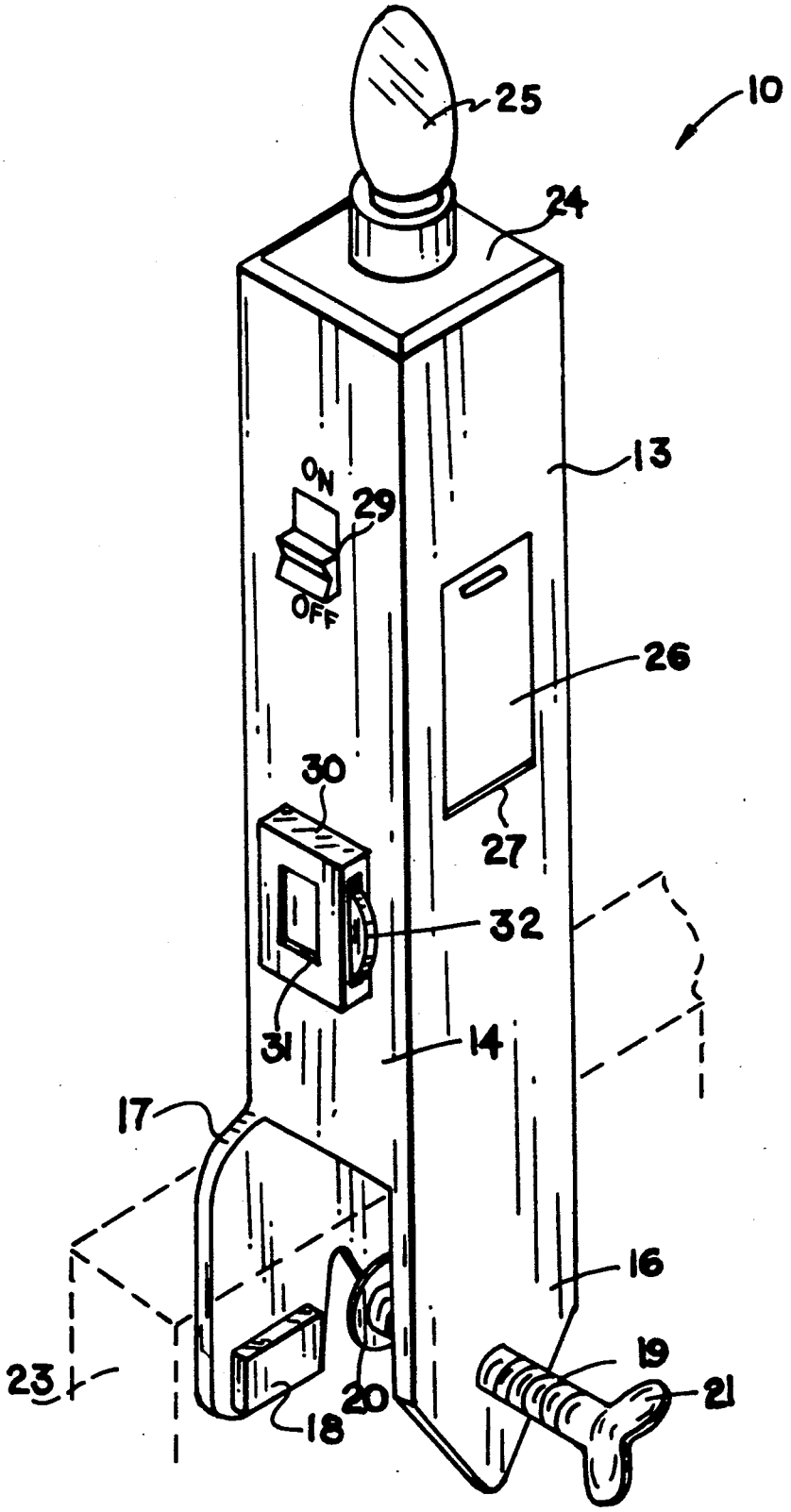
FIG. 1 is an isometric illustration of the instant invention.

With reference now to the drawings, and in particular to FIGS. 1 to 6 thereof, a new and improved bingo flasher apparatus embodying the principles and concepts of the present invention and generally designated by the reference numerals 10, **10*a*, and 10*b*** will be described.

More specifically, the bingo flasher apparatus 10 of the instant invention essentially comprises an elongate axially aligned housing of a generally parallelepiped configuration, including a front wall 12 spaced from and parallel a rear wall 13, and a first side wall 14 spaced from and parallel a second side wall 15 The first side wall 14 and the second side wall 15 are defined by a second length relative to the first length defined by the front and rear walls 12 and 13, wherein the second length is less than the first length to define a slot 22 of a predetermined rectangular configuration directed between a rear wall extension leg 16 and a front wall bifurcated extension leg 17. The bifurcated extension leg 17 includes a resilient pad member 18 mounted on an interior face of each extension leg in a confronting relationship relative to the rear wall extension leg 16. An externally threaded screw rod 19 is threadedly directed through the rear wall extension leg 16 orthogonally oriented relative to and bisecting the bifurcated extension leg 17. The screw rod 19 includes a screw rod foot plate 20 to an interior end of the rod 19, and a head member 21 arranged for enhanced manual rotation of the screw member to permit securement of a chair 23, as illustrated in FIG. 1 for example in phantom, between the rear wall extension leg 16 and the front wall bifurcated extension leg 17.

The housing includes a housing top wall 24 mounting an illumination bulb 25 thereon, the illumination bulb is operative through an on/off switch 29 directed through the first side wall 14 and a battery 28 (see FIG. 3) mounted within a compartment accessed through a battery door plate 26 directed through the rear wall 13, with the battery door plate 26 including a hinge 27 permitting pivotment of the battery plate 26 for ease of access to the battery 28.

A game counter housing 30 is mounted below the on/off switch on the first side wall 14 that includes a window 31 and a rotary dial 32 projecting through the counter housing 30 and exteriorly thereof to permit positioning of an indicator number within the window 31 for indicating which game has been won, as the user will effect illumination of the bulb 25 and indication of the particular game that has been won within the window 31 for their use in concert to aid that user to proceed in subsequent play of further bingo games.

Figure 5:
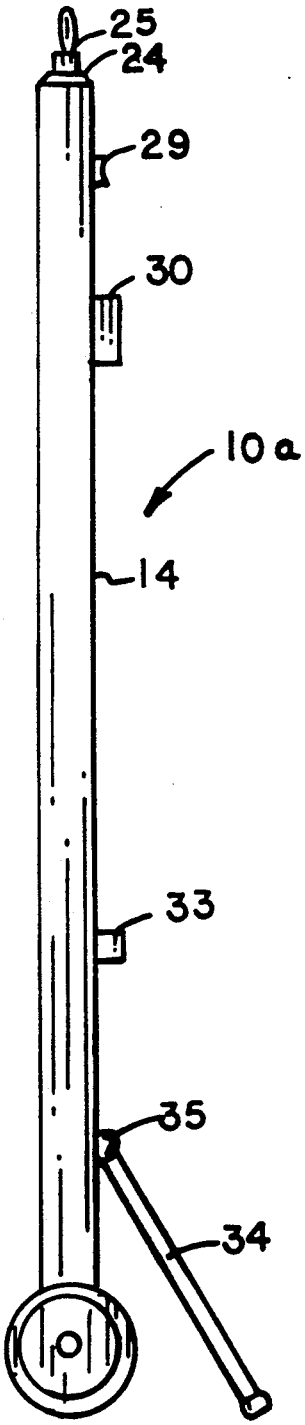
FIG. 5 is an orthographic side view of a modification of the instant invention.
Figure 6:
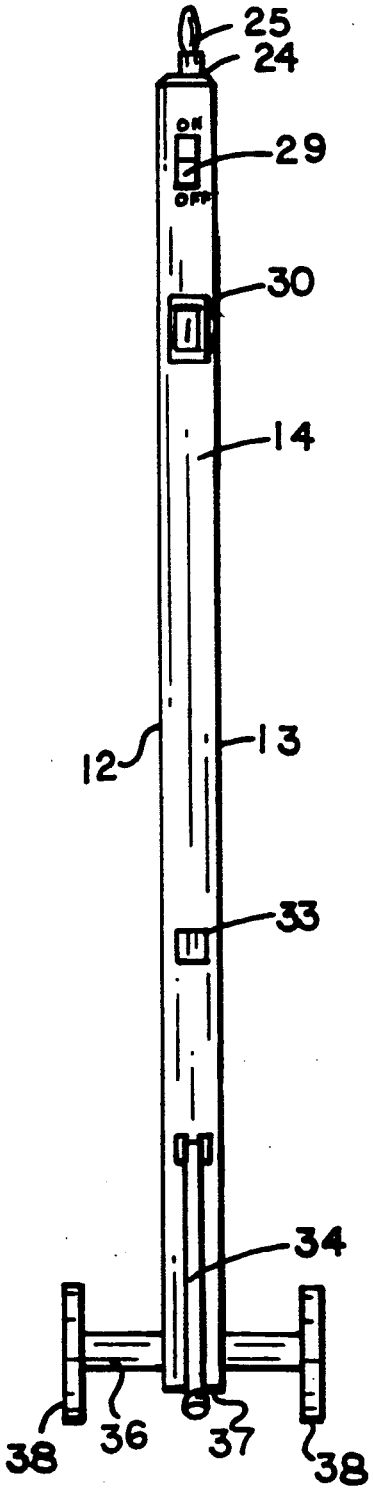
FIG. 6 is an orthographic front side view of the invention, taken in elevation as in FIG. 5.

FIGS. 5 and 6 illustrate a modified apparatus 10*a*, wherein the housing 11 is elongate and includes a "U" shaped spring clip 33 positioned below the counter housing 30 for securement of a support leg 34. The support leg 34 is pivoted within a support leg pivot 35 at a first end of the support leg adjacent the first side wall 14. The side leg is swung to a second position from a first locked position for permitting free standing of the organization, as illustrated, with an axle 36 orthogonally directed through the front and rear walls 12 and 13, including a wheel member at each opposed terminal end of the axle. The axle is positioned adjacent the housing bottom wall 37.

Figure 2:
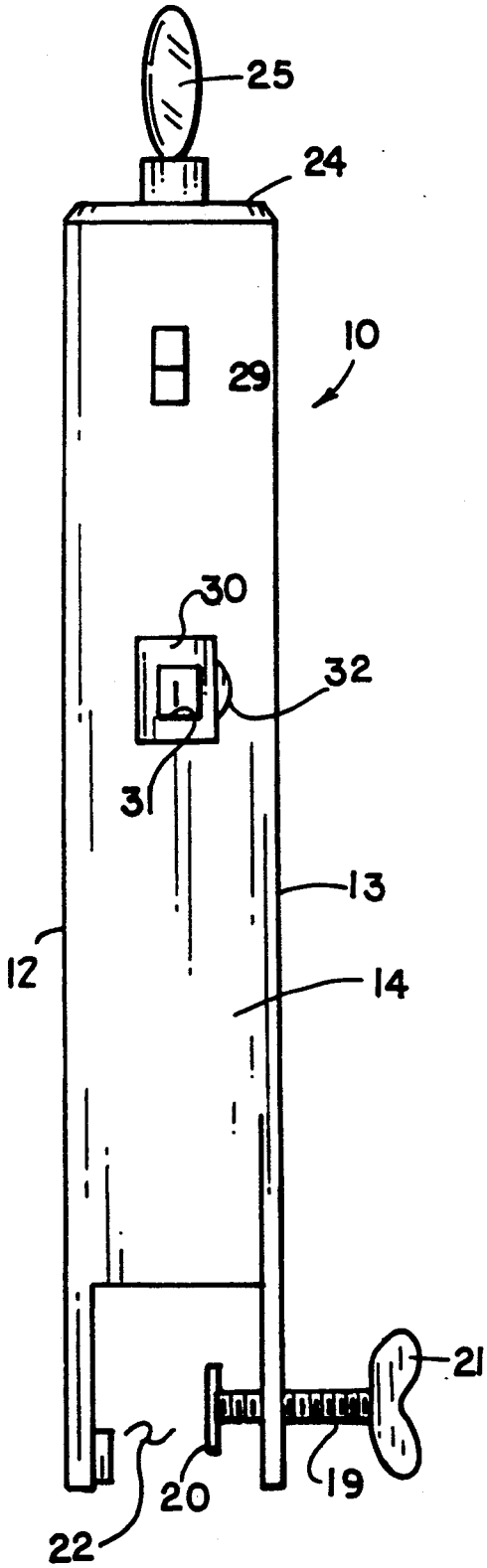
FIG. 2 is an orthographic first side view of the instant invention, taken in elevation.
Figure 3:
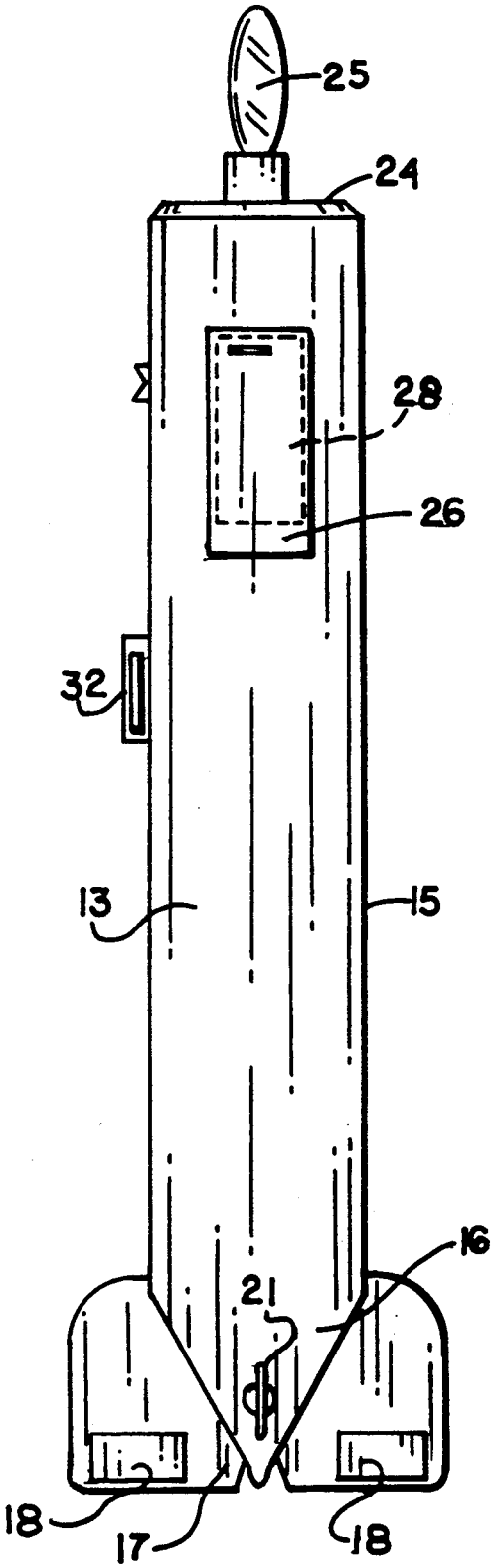
FIG. 3 is an orthographic second side view of the invention, taken in elevation.
Figure 4:
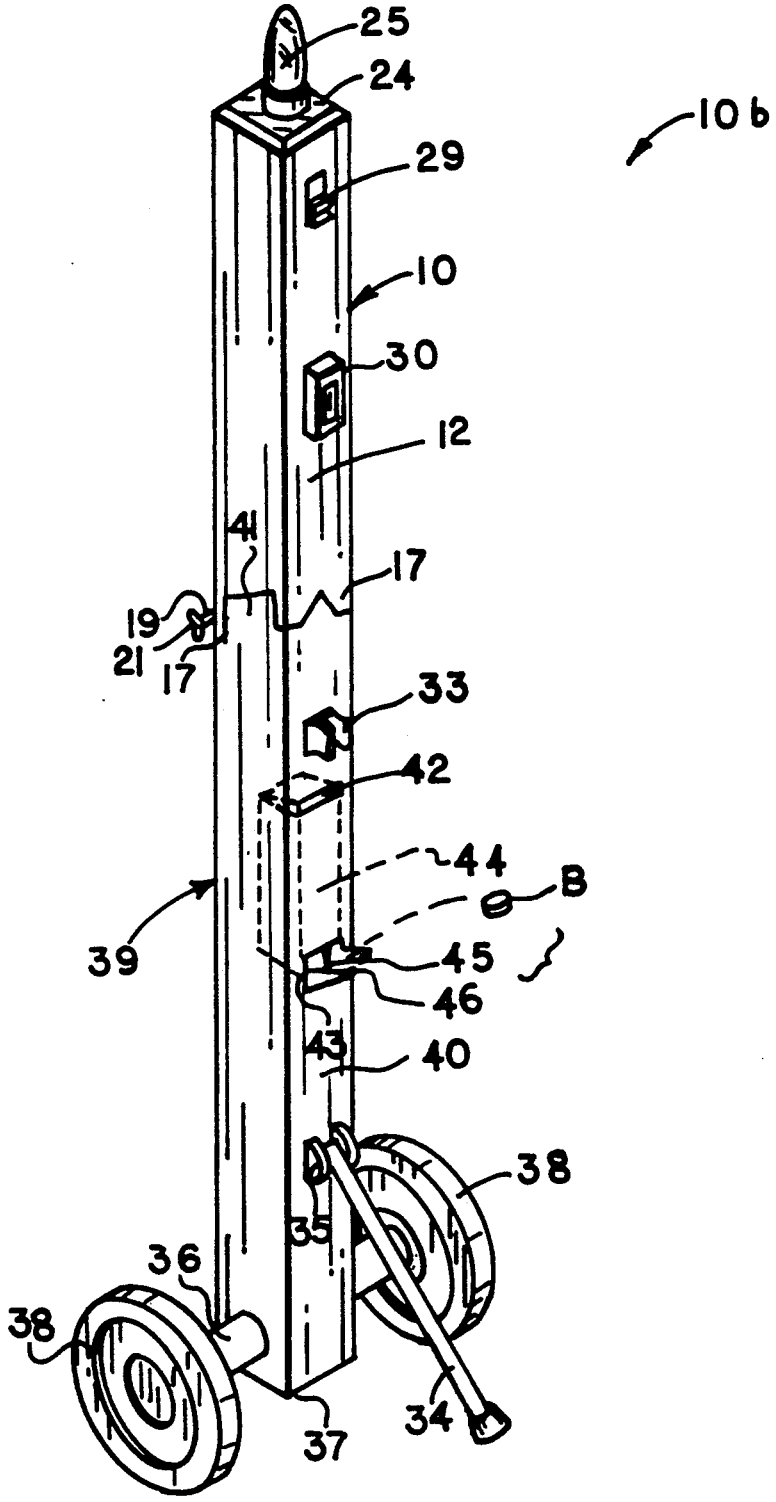
FIG. 4 is an isometric illustration of a modified organization incorporating the apparatus as set forth in FIGS. 1-3.

The further modified apparatus of FIG. 4, set forth as the apparatus 10*b*, includes the front wall of the apparatus 10 mounting the switch 29 and the counter housing 30. The apparatus 10 includes a lower terminal end defining the slot 22 receiving a support housing shaft 41 formed at an upper terminal end of the mobile support housing 39, as illustrated. The mobile support housing 39 includes a mobile support housing front wall 40 coplanar with the front wall 12 of the housing 11 to position the various components for ease of access and in alignment relative to one another. The screw rod 19, as illustrated, is directed through the rear wall 13, in a manner as illustrated in FIGS. 1–3. The shaft 41 is coaxially aligned with the housing 11 and the mobile support housing 39. The mobile support housing 39 includes a mobile support housing bottom wall 37 directing the axle 36 through opposed side walls of the mobile support housing, in a manner as described above. Further, the mobile support housing 39 includes a top bingo chip slot 42 positioned below the "U" shaped spring clip 33 that receives the support leg 35 in a raised first position that positions the support leg in a parallel alignment relative to the front wall 12 and the support housing front wall 40. A bottom slot 43 is positioned below the top slot, wherein the bottom and top slot permit directing of bingo chips "B" therewithin and their subsequent removal from within a chute 44 that communicates the top and bottom slots 42 and 43. The chute 43 is aligned with a lower tray 45. The lower tray 45 includes a medial tray slot 46 directed medially through a forward edge of the lower tray 45 to permit a two-fold usage as a finger access for removing a bingo chip "B" therefrom, as well as permitting the support leg 34 to be received within the medial slot 46 of the tray 45 permitting its securement to the "U" shaped spring clip 33. Accordingly an individual thereby is further provided With a magazine support for the bingo chips utilized in a game minimizing distraction of a player from a bingo game procedure.

It should be further noted that the apparatus 10*b* accordingly permits the housing 11 to be selectively secured to a chair 23 or alternatively to the mobile support housing 39, as required by an individual.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention.

What is claimed as being new and desired to be protected by Letters Patent of the United States is as follows:

1. A bingo flasher apparatus, comprising in combination, an elongate coaxially aligned housing, wherein the housing includes a front wall spaced from and parallel a rear wall, the housing further includes a first side wall spaced from and parallel a second side wall, the front wall and the rear wall are each defined by a first length, and the first side wall and the second wall defined by a second length, wherein the second length is less than the first length, the front wall includes a front wall bifurcated extension leg, the rear wall includes a rear wall extension, wherein the rear wall extension is arranged parallel to the front wall bifurcated extension leg to define a slot therebetween, the rear wall includes an externally threaded screw rod orthogonally and threadedly directed through the rear wall extension leg, the externally threaded screw rod includes a foot plate positioned within the slot at a forward terminal end of the screw rod, a head member positioned exteriorly of the slot at a rear terminal end of the screw rod, the front wall includes as on/off switch, wherein said first side wall includes a battery chamber, with the battery chamber including a battery door plate hingedly mounted to the first side wall, and a battery mounted within the chamber, the housing including a top wall, and an illumination bulb mounted to the top wall, wherein the switch is in electrical communication with the battery and the illumination bulb to effect selective illumination of the illumination bulb, and wherein the front wall includes a game counter housing, the game counter housing includes a window directed through the game counter housing, and a rotary dial projecting exteriorly of the game counter housing for effecting selective positioning of a predetermined digit within the window.

2. An apparatus as set forth in claim 1 further including a mobile support housing, and the elongate coaxially aligned housing is selectively securable and coaxially aligned with the mobile support housing when the elongate coaxially aligned housing is secured to the mobile support housing, and the mobile support housing including a top wall, the top wall including a mobile support housing shaft, the shaft complementarily received within the slot defined between the rear wall extension leg and the front wall bifurcated extension leg, and the mobile support housing including a mobile support housing front wall, the mobile support housing front wall includes a support leg, the support leg pivotally mounted to the mobile support housing front wall at a first terminal end of the support leg, and the mobile support housing front wall includes a "U" shaped spring clip mounted to the mobile support housing front wall below the mobile support housing top wall, and the support leg selectively securable to the "U" shaped spring clip in a first position and pivoted outwardly of the "U" shaped spring clip to a second position, and the mobile support housing including a mobile support housing floor, and an axle shaft directed orthogonally through the mobile support housing adjacent a lower terminal end of the support housing, and the axle including a rotary wheel mounted at each end of the axle.

3. An apparatus as set forth in claim 2 further including a bingo chip top slot projected through the mobile support housing front wall positioned below the "U" shaped spring clip, and a bottom bingo chip slot positioned below the top bingo chip slot and above the first terminal end of the support leg pivotally mounted to the mobile support housing front wall, and the chute intercommunicating the top bingo chip slot with a bottom bingo chip slot, wherein the chute is contained within the mobile support housing, and a lower tray, the lower tray aligned with the bottom bingo chip slot, and the tray including a medially positioned tray slot directed through a forward edge of the lower tray orthogonally oriented relative to the mobile support housing front wall to receive the support leg in the first position.

* * * * *